US007047987B2

(12) United States Patent
Cerruti et al.

(10) Patent No.: US 7,047,987 B2
(45) Date of Patent: May 23, 2006

(54) WASHING AGENT DISPENSING DEVICE FOR A HOUSEHOLD WASHING MACHINE, IN PARTICULAR A DISHWASHER

(75) Inventors: Daniele Cerruti, Fontanetto (IT); Giovanni Perrucca, Motta de'Conti (IT)

(73) Assignee: Eltek, S.p.A., Monferrato (IT)

( * ) Notice: Subject to any disclaimer, the term of this patent is extended or adjusted under 35 U.S.C. 154(b) by 311 days.

(21) Appl. No.: 10/239,489

(22) PCT Filed: Mar. 26, 2001

(86) PCT No.: PCT/IB01/00480

§ 371 (c)(1),
(2), (4) Date: Nov. 4, 2002

(87) PCT Pub. No.: WO01/73182

PCT Pub. Date: Oct. 4, 2001

(65) Prior Publication Data

US 2004/0020517 A1 Feb. 5, 2004

(51) Int. Cl.
*A47L 15/44* (2006.01)

(52) U.S. Cl. ..... 134/58 D; 134/93; 134/99.2; 68/17 R

(58) Field of Classification Search ..... 134/99.2, 134/93, 94.1, 100.1; 222/651, 652, 425; 68/17 R
See application file for complete search history.

(56) References Cited

U.S. PATENT DOCUMENTS

| | | | | |
|---|---|---|---|---|
| 2,872,941 | A * | 2/1959 | Soucy | 137/576 |
| 3,827,600 | A * | 8/1974 | Janke | 222/651 |
| 3,876,117 | A * | 4/1975 | Wright et al. | 222/651 |
| 6,255,934 | B1 * | 7/2001 | Gadini et al. | 337/393 |
| 6,453,917 | B1 * | 9/2002 | Biechele | 134/99.2 |

* cited by examiner

*Primary Examiner*—Joseph L. Perrin
(74) *Attorney, Agent, or Firm*—Levine & Mandelbaum

(57) ABSTRACT

A device for dispensing washing agents is described, for a household washing machine, in particular a dishwasher, said dispenser having at least a tank for a liquid washing agent and an arrangement for dispensing a dose of said washing agent. The arrangement comprises:

a passage for putting the inside of said tank in communication with a discharge outlet;

plugging means for said passage, at least an actuator for operating said plugging means.

According to the invention, said plugging means comprise an element being movable within said passage and bearing sealing means, whereby the movable element, in a first position, allows to realize the dosage of an amount of washing agent and, in a second position, allows to dispense the dosed amount of washing agent.

48 Claims, 9 Drawing Sheets

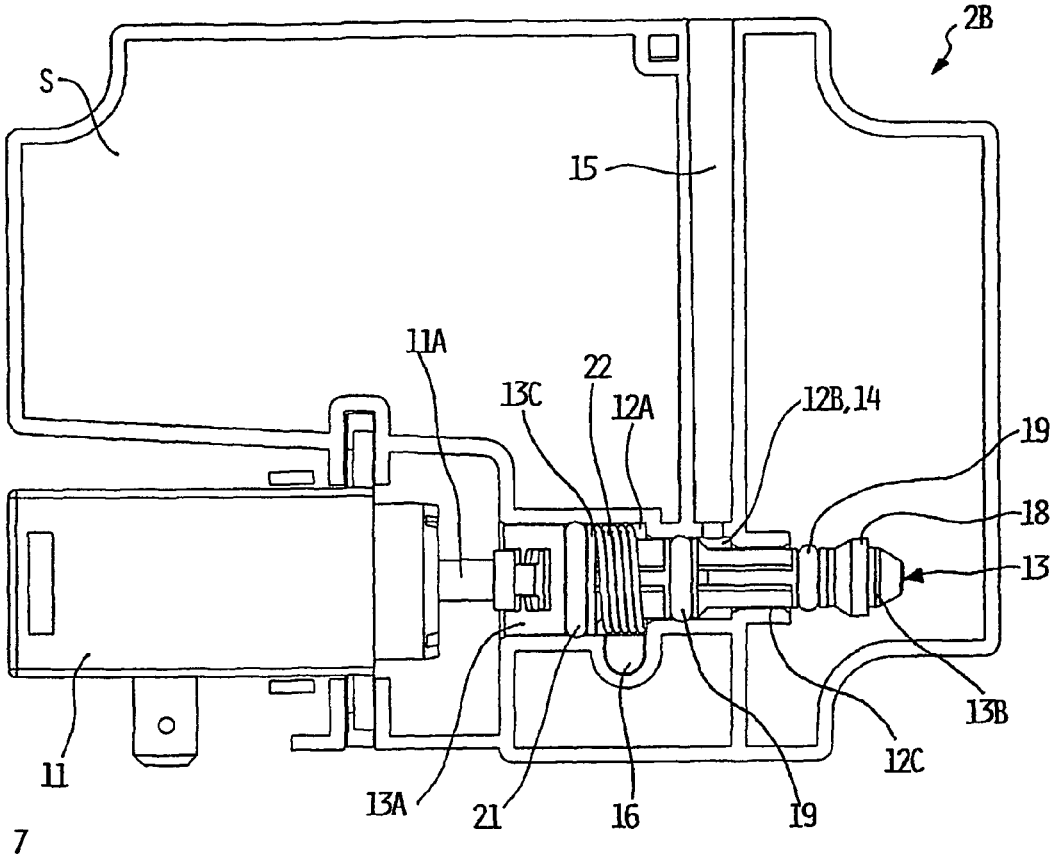
FIG. 7
FIG. 8
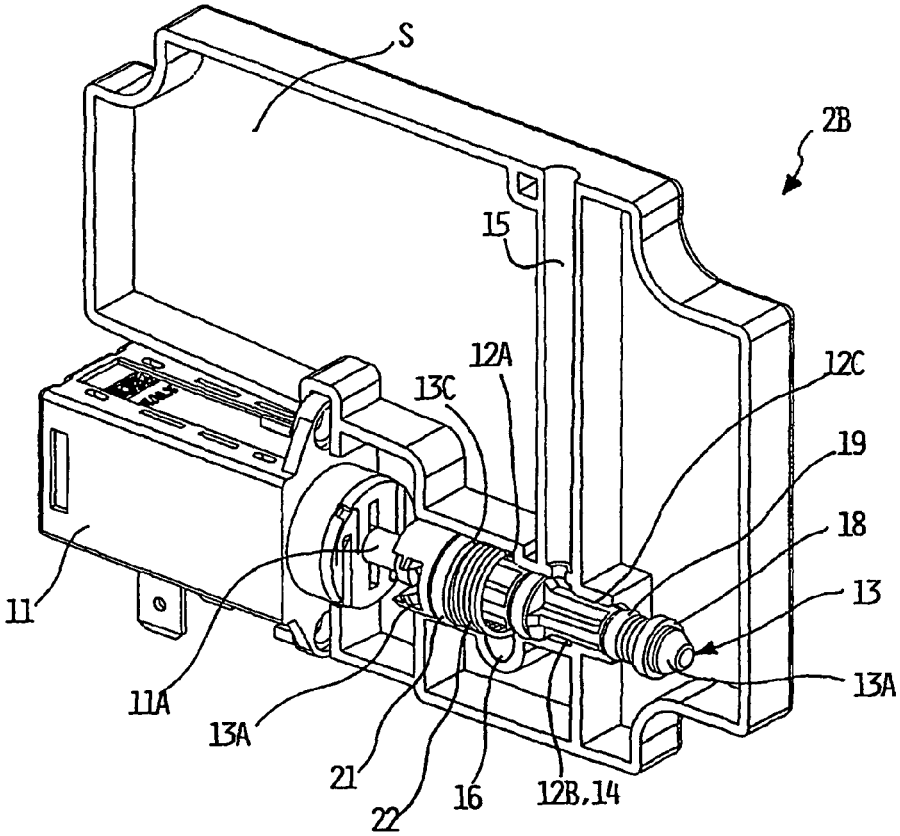

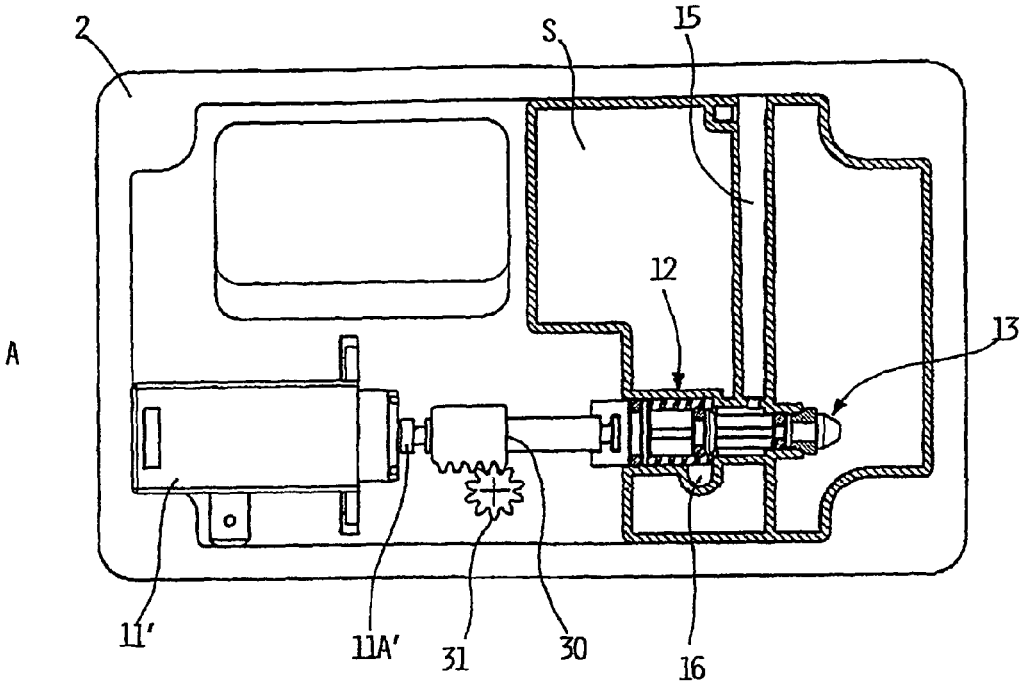
FIG. 10
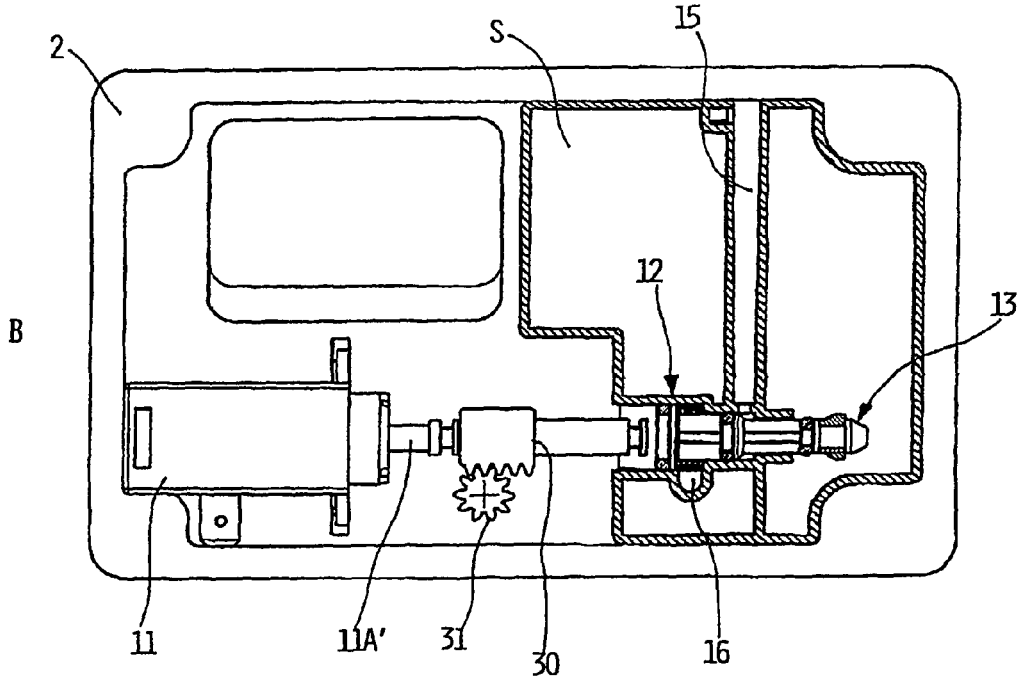

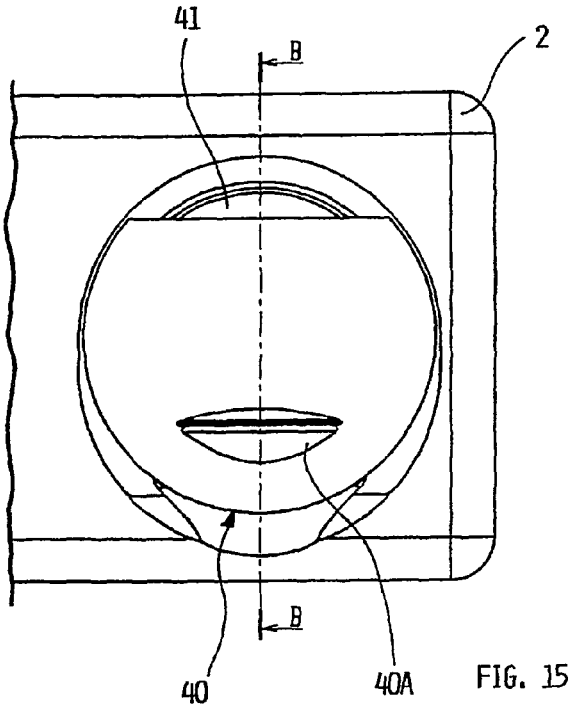
FIG. 15
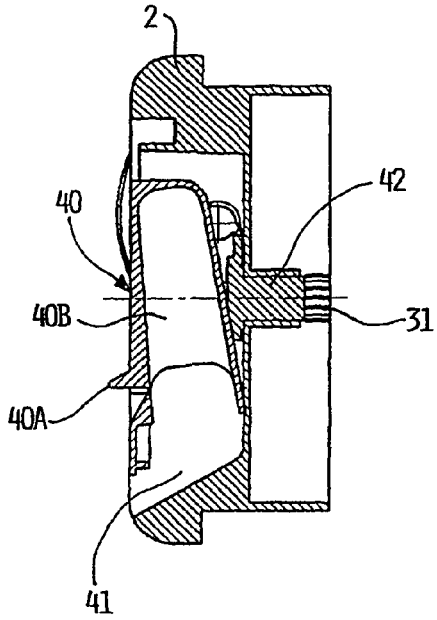
FIG. 16
FIG. 17
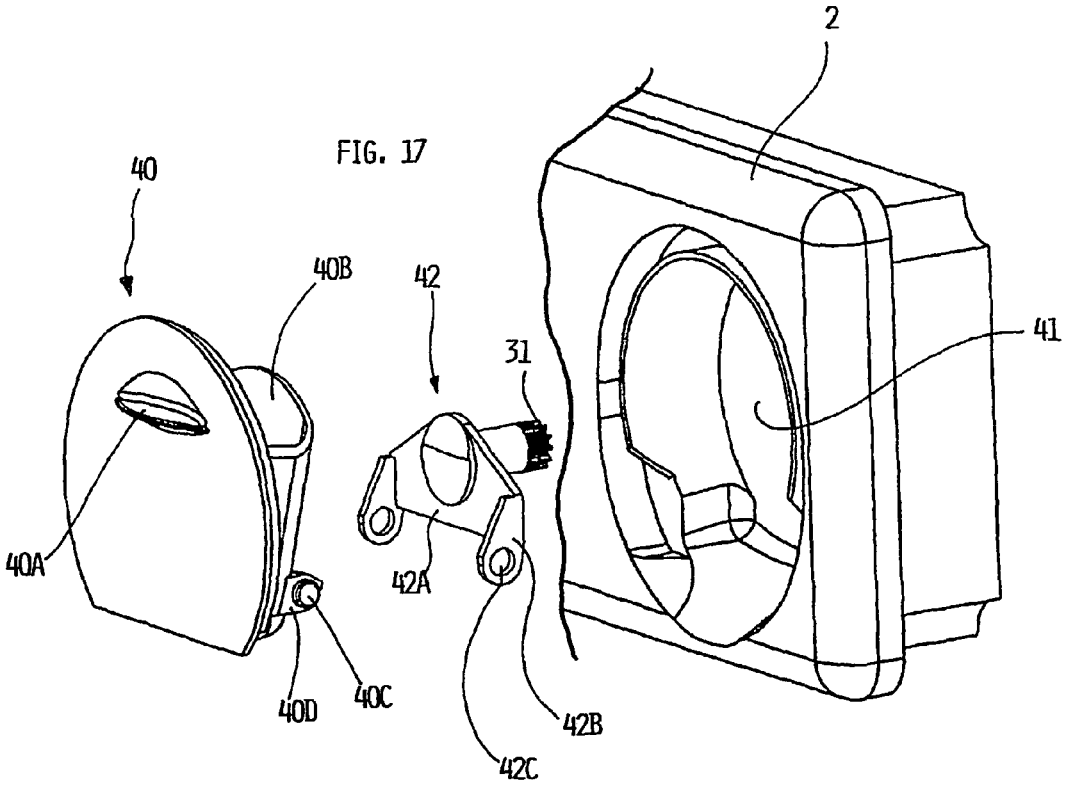

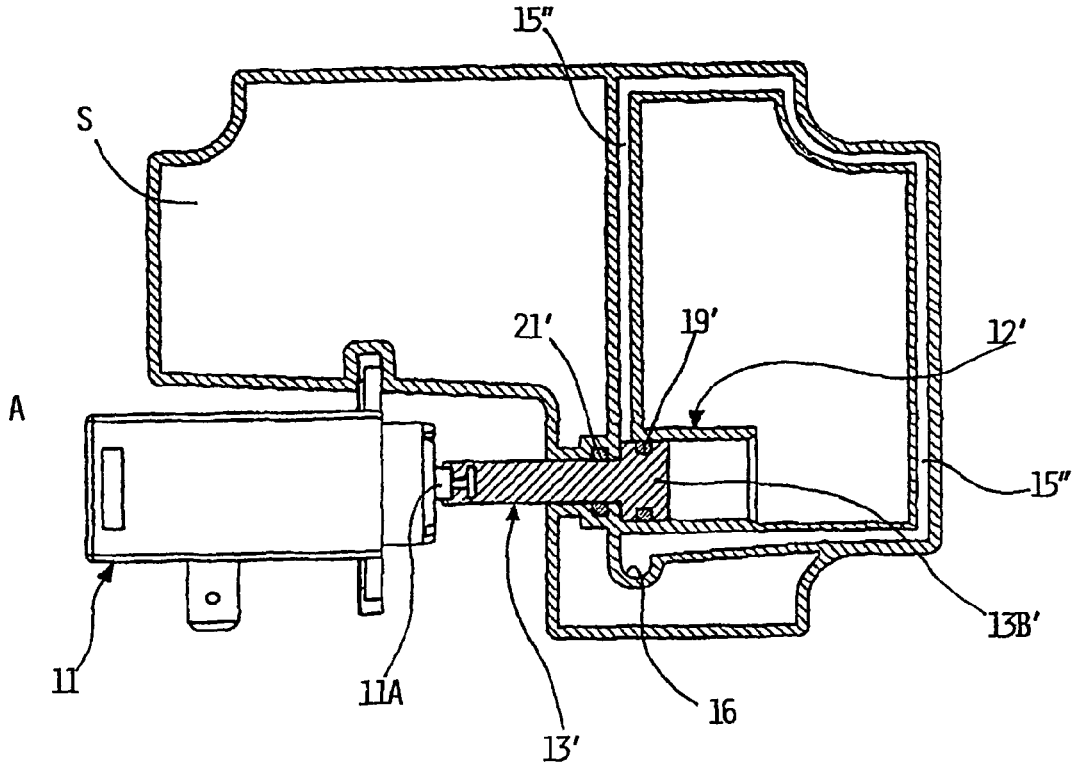
FIG. 18
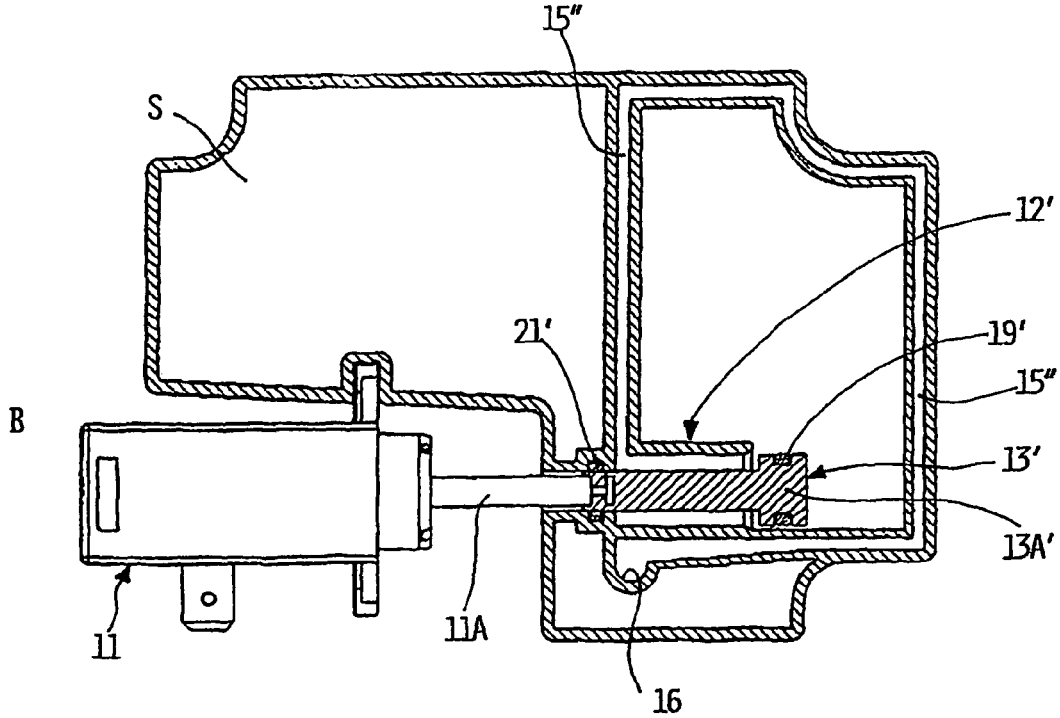

WASHING AGENT DISPENSING DEVICE FOR A HOUSEHOLD WASHING MACHINE, IN PARTICULAR A DISHWASHER

BACKGROUND OF THE INVENTION

The present invention refers to a device for dispensing washing agents for a household washing machine, in particular a dishwasher.

As known, washing machines are usually fitted with a dispensing device of washing agents, namely powder and/or liquid detergents and additives; typically, the latter consist of softening media for laundry washing machines and rinsing aids for dishwashing machines.

In the instance of a dishwasher, the dispenser of washing agents usually comprises a body made from plastic material, partially built-in on one of the vertical surfaces delimiting the washing tub of the machine; in most cases, this vertical wall is the dishwasher inner door, i.e. the side of the machine front loading door facing inside the washing tub.

In its front area, the above body delimits a space for containing a detergent, usually in powder or in the form of a tablet, with a tilting or sliding cover; the opening of this small cover is appropriately controlled by a machine programmer or timer.

Inside the dispenser body a tank is provided, for containing a second liquid washing agent, typically a rinsing aid; in general, this tank has the capacity for containing a sufficient amount of liquid agent for several washing cycles, so that the machine user has only to fill the tank periodically, through a proper plug.

Inside the dispenser a small chamber is associated to the above tank, which is used for dosing the amount of rinsing aid to be dispensed during a washing cycle: to this purpose the dosing system of the rinsing aid exploits the opening-closing movement of the machine door, i.e. horizontal when open and vertical when closed, for supplying a portion of rinsing aid from the tank to the dosing chamber; during machine operation, the programmer operates an actuator to free a discharge outlet in correspondence with the dosing chamber, and let the amount of rinsing aid flow from the latter into the washing tub of the dishwasher.

As said, the known technique mentioned above requires the dispenser to be fastened to the dishwasher door, in order to exploit its opening-closing movement for dosing the rinsing aid required for a washing cycle; for this reason, the application of these dispensers is restricted on washing machines having a door tilting around a horizontal axis.

However, some known washing machines are not fitted with a tilting loading door, but the latter is linearly sliding on appropriate guides; with reference to a double-basket dishwashing machine, reference can be made, for example, to the solution described in FR-A-2.674.426; vice-versa, in other known solutions, the dishwasher has only one basket containing the crockery to be washed, which is designed like a sliding drawer with its front wall representing in fact the machine door.

Also in these machines the dispenser of the washing agents is fastened to the machine door or anyway to a wall or vertical surface delimiting the washing tub; as a result, the dispenser is always on the same resting plane, independently from the door opening-closing condition.

Therefore, the dispensers applied on such machines have to be equipped with a proper electric pump, of the vibration or peristaltic type, capable of dosing and dispensing the liquid washing agent; anyway, these pumps are relatively expensive, space requiring and difficult to control; moreover, these pumps may go out of calibration or become defective with time, also considering a certain corrosive capacity of certain liquid washing agents.

Other solutions provide on the contrary a special hydraulic circuit, able to convey water inside the device for dispensing the liquid washing agent and convey it into the machine washing tub; however, also these solutions are complicated, expensive and critical, considering that such an hydraulic circuit should be partially housed within the machine door.

SUMMARY OF THE INVENTION

It is the object of the present invention to solve the above drawbacks and provide a device for dispensing washing agents able to perform the dosage and the dispensing of a liquid washing agent, which is easy to manufacture, has a reliable operation and a low cost.

Within this general frame, a first aim of the present invention is to provide a device for dispensing washing agents where the dosage and the dispensing of a liquid washing agent can be realized without requiring any vibration or peristaltic pumps, nor special water supply circuits, and without changing the resting plane of the dispenser itself.

A further aim of the present invention is to provide a dispensing device of washing agents, which comprises a minimum number of movable parts, in particular being subject to elementary movements.

A further aim of the present invention is to provide a dispensing device of washing agents which employs simple and reliable actuating and sealing means.

A further aim of the present invention is to provide a dispensing device of washing agents which can be assembled either on tilting doors or sliding doors, as well as on surfaces being constantly vertical.

One or more of these aims are attained, according to the present invention, by a device for dispensing washing agents for a household washing machine, in particular a dishwasher, incorporating the features of the annexed claims, which form an integral part of the description herein.

DESCRIPTION OF THE DRAWINGS

Further aims, features and advantages of the present invention will become apparent from the following detailed description and annexed drawings, which are supplied by way of non limiting example, wherein:

FIGS. 7 and 8 show a section, as a front view and perspective view, respectively, of the dispenser represented in FIG. 4, in a second operating condition;

FIG. 10 shows schematically a partial section of the rear part of a dispenser of washing agents according to a second possible embodiment of the present invention, in two different operating conditions;

FIG. 15 shows a partial front view of the dispenser of washing agents of FIGS. 11 and 13 in a third operating condition;

FIG. 16 shows a section of the dispenser of washing agents along the axis B—B of FIG. 15;

FIG. 17 shows an exploded partial view of some components of the dispenser of washing agents of FIGS. 11, 13 and 15;

FIG. 18 shows schematically a partial section of the rear part of a dispenser of washing agents according to a fourth possible embodiment of the present invention, in two different operating conditions.

DESCRIPTION OF THE PREFERRED EMBODIMENT

Figure 1:
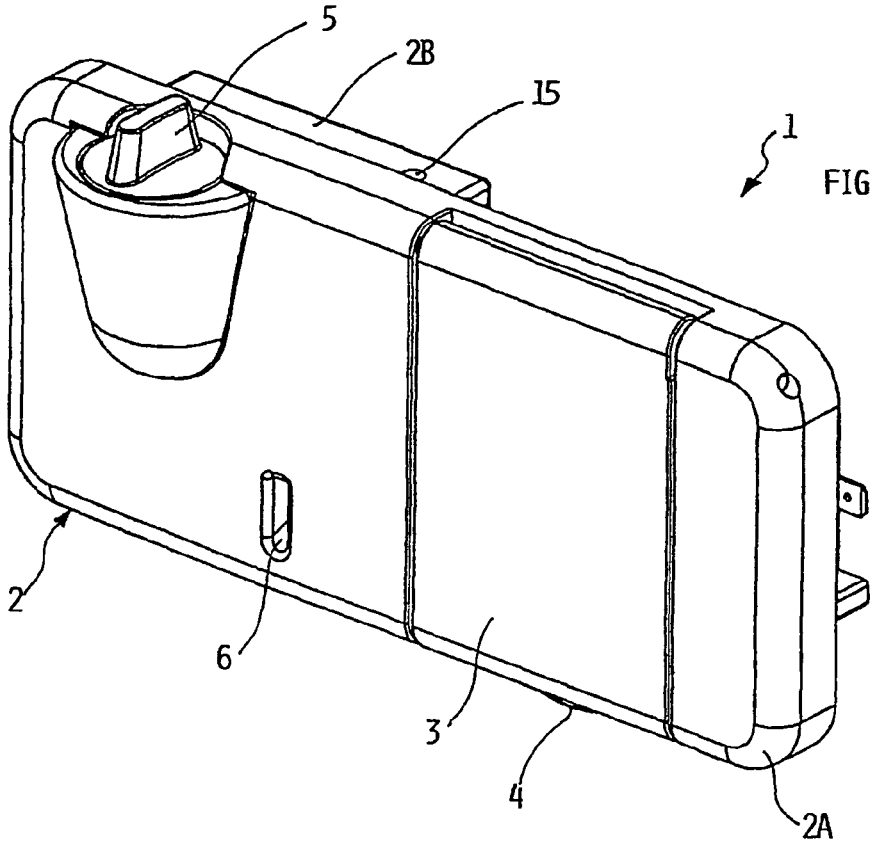
FIG. 1 shows a perspective view of the front part of a dispenser of washing agents, according to the present invention.
Figure 2:
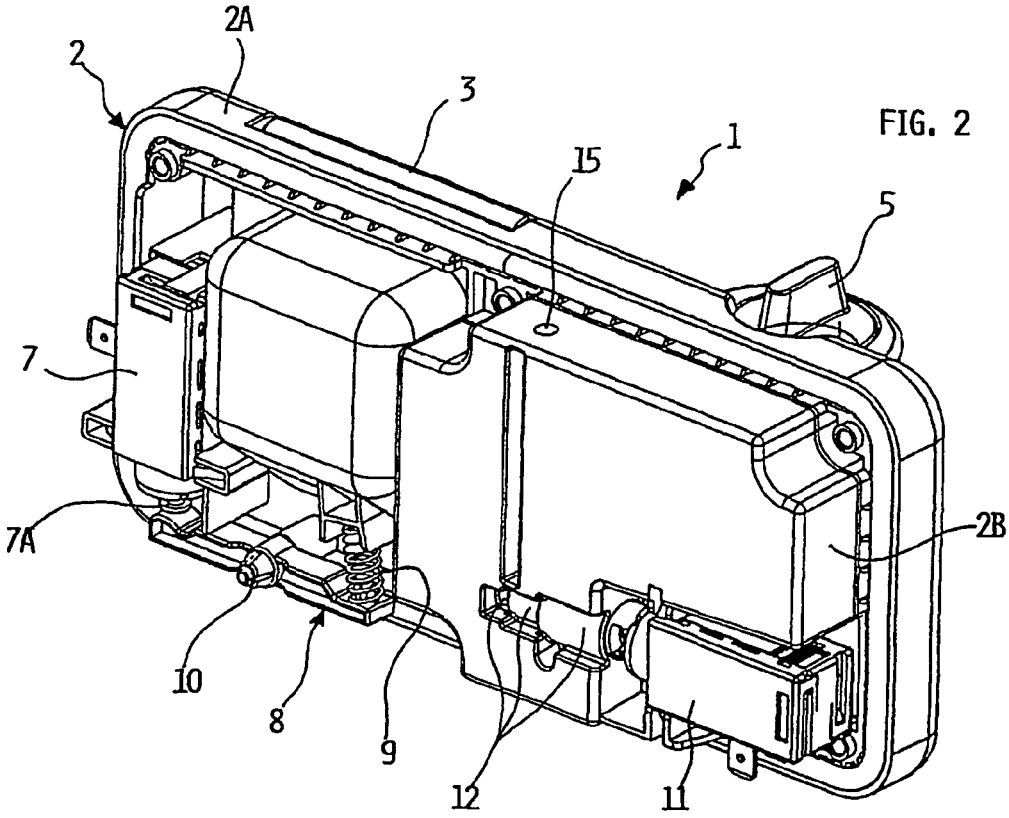
FIG. 2 shows a perspective view of the rear part of a dispenser of washing agents, according to the present invention.

In FIGS. 1 and 2, reference 1 indicates as a whole a dispenser of washing agents according to the teachings of the present invention, provided for the application in a washing machine, which is a dishwasher in the example herein described.

The dispenser 1 has a main body 2, housed at least partially in an opening on a machine wall, in particular on the inner door, which may be a tilting or sliding door; in general, the body 2 can be fixed to any vertical surface delimiting a washing tub of the washing machine.

As known in the art, the body 2 of the dispenser 1 is obtained by welding a front piece to a rear piece, both made from thermoplastic material, indicated in FIG. 2 with 2A and 2B, respectively.

The body 2 delimits a space for containing a determined amount of detergent, either in the powder or the tablet form, as well as a tank for containing a certain amount of a liquid washing agent, hereafter assumed to be a rinsing aid; the above space and tank are not directly shown in FIGS. 1 and 2.

Reference 3 indicates a small cover which can be tilted upwards, for the closure of the space containing the detergent, whose upper part is hinged in a known way to the piece 2A of the body 2; in FIG. 1, reference 4 indicates schematically a hooking lever for the small cover 3, of the known type, to keep the latter in its closed position on the space for containing the detergent.

Reference 5 indicates the plug of an opening in communication with the above tank, for charging the rinsing aid to the latter.

Reference 6 indicates an outlet through which a dose of rinsing aid can be flown down into the washing tub of the dishwasher, as per the procedure further described.

As it can be noticed, the seat of the plug 6 is so designed to have its inlet rinsing aid for the rinsing aid opening facing upwards; this configuration allows an easier charging of the liquid washing agent when the dispenser 1 is fastened to a linear sliding door or a constantly vertical surface; should the dispenser 1, vice-versa, be fastened to a tilting door, the above configuration allows filling the tank with rinsing aid also with the door half opened.

In FIG. 2 reference 7 indicates a first actuating device, being fixed in a known way to the piece 2A of the body 2, which is provided for operating the hooking lever 4; in particular, the actuating device 7 may consist of a thermo-actuator having a general structure as described in WO-A-98/32141, whose relevant teachings are herein incorporated by reference.

It can be mentioned here that thermo-actuators as the one indicated with 7 comprise an outer housing, within which a body is located, made from an electric and thermal conducting material (e.g. metal) connected to an electric heater; in this body a chamber is defined, for containing a thermally expandable material (e.g. wax) and at least partially a thrusting element, able to displace a piston protruding from the outer housing; typically, the electric heater consists of a PTC resistor with a positive temperature coefficient, electrically supplied by means of two terminals.

When the supply terminals are live, the electric heater supplied with current generates heat and causes the thermally expandable material to expand: such an expansion produces a linear displacement of the thrusting element outside the relevant body, causing a movement of the piston until a determined position, generally established by a mechanical stop, is reached, which can be defined as a final work position. Upon ceasing the power supply, the heater cools down and the thermo-expandable material shrinks, so causing the piston and pusher to return to their initial rest position, eventually with the aid of an elastic recall element, such as a spring.

Thermo-actuators as above are mono-stable devices, i.e. besides their normal rest position they ensure only one work stroke and one final work position. Such actuators offer important advantages in view of the considerable working strength or power they are able to develop related to their small size, the low costs, the low consumption and the noiseless operation.

Back to FIG. 2, reference 8 indicates a lever with a first end located under a piston 7A of the thermo-actuator 7; reference 9 indicates a pressure spring operating between the second end of the lever 8 and the body 2; a shaft 10, which is made integral to an intermediate site of the lever 8, is inserted in a respective passage through the piece 2A of the body 2 and connected to the hooking lever 4 of FIG. 1.

As a result, the thermo-actuator 7, the lever 8, the spring 9, the lever 4 and the shaft 10 form a substantially known opening system for the small cover 3.

At an appropriate time of the washing cycle, the control system of the machine supplies power to the thermo-actuator 7; thereafter, the piston 7A moves downwards and causes an angular displacement of the lever 8 around the fulcrum point realized by the shaft 10; this movement of the lever 8 causes the shaft to rotate, with a consequent movement of the lever 4 such to release the small cover 3; subject to the action of a relevant spring not represented in the figures, the latter opens and let the detergent fall down from the relevant space by gravity into the washing tub of the dishwasher.

Always referring to FIG. 2, reference 11 indicates a second actuating device fixed to the piece 2B of the body 2, pertaining to a dispenser of the rinsing aid contained in the relevant tank; also the actuating device 11 may consist of a thermo-actuator like the one indicated with 7.

Reference 12 indicates as a whole a seat for the sliding of a shaft, to be further described, which is used for the dosage of the rinsing aid; as it can be noticed, in the given example, the seat 12 has three lengths, having respective sections of decreasing dimensions.

Figure 3:
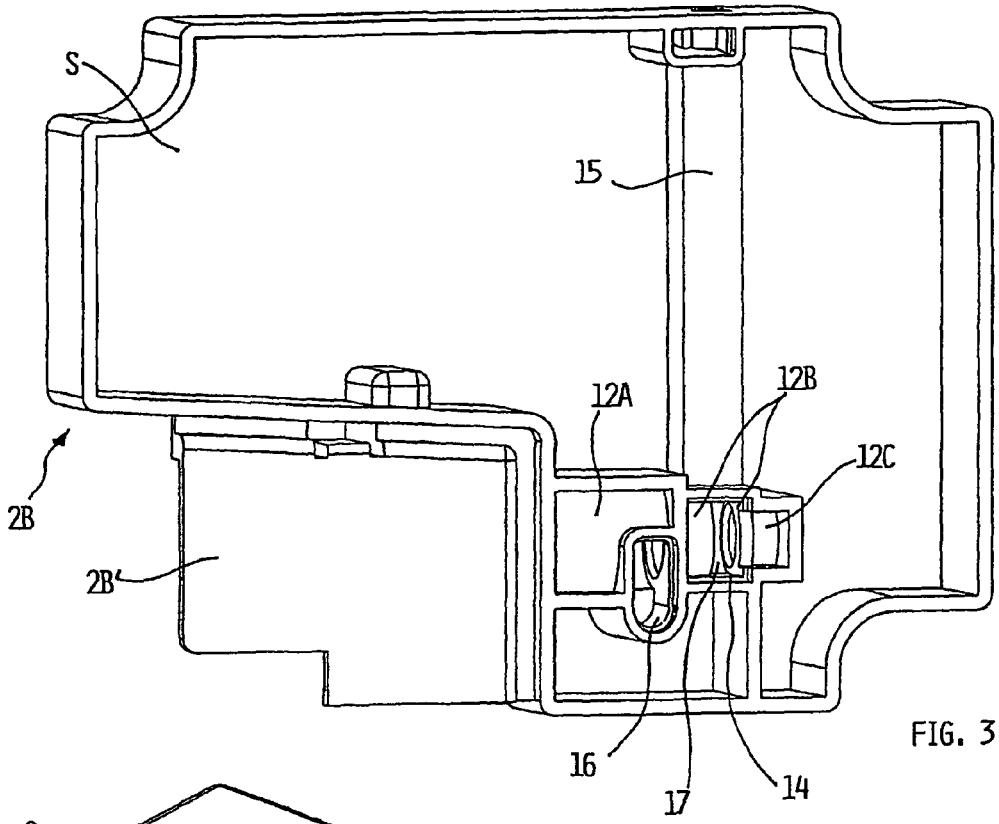
FIG. 3 shows, through a perspective view, a component of the dispenser of washing agents according to the present invention.
Figure 4:
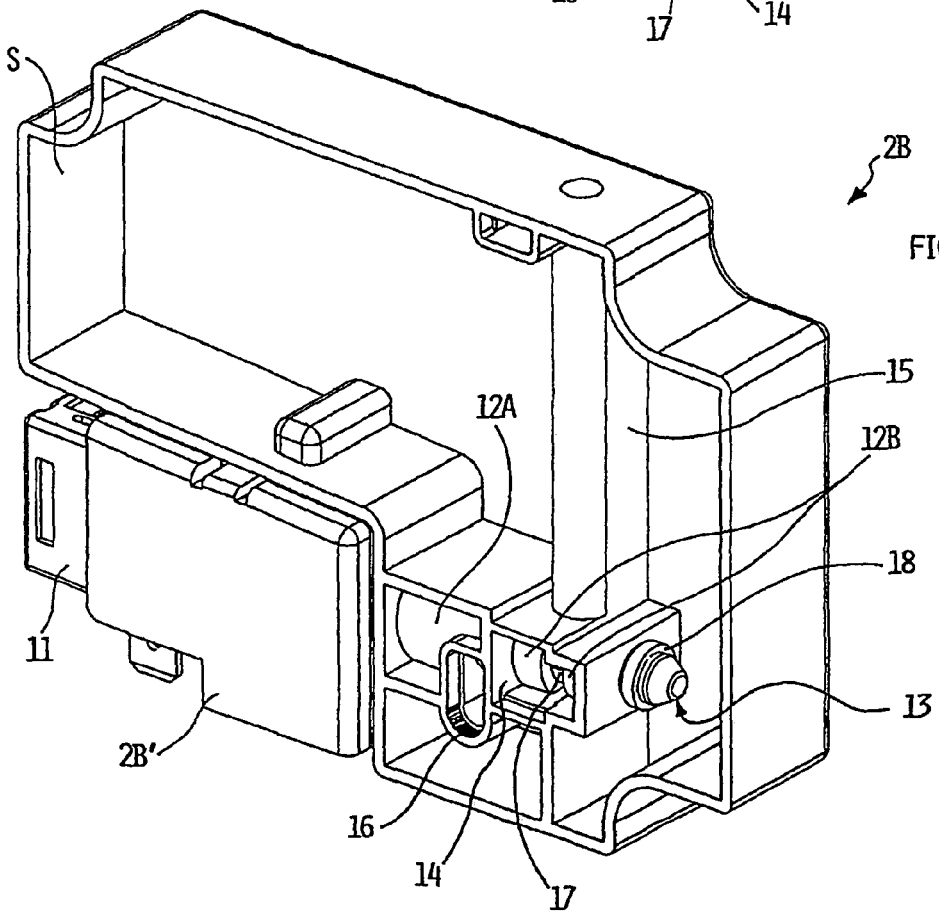
FIG. 4 shows, through a perspective view, the essential elements of a dispenser of liquid washing agents, assembled on the component represented in FIG. 3.

In FIG. 3 only the piece 2B can be seen, of the body 2 of the dispensing device 1 according to the present invention, while in FIG. 4 the same part is associated to the components of a rinsing aid dispenser; as it will be noticed, these figures represent substantially a front view of the piece 2B before the latter is welded to the piece 2A; for clarity's sake, in the instance of FIG. 4 it should also be noticed how to the piece 2B the thermo-actuator 11 is already associated, though in reality it will be assembled after the two the pieces 2A and 2B of the body 2 have been welded together.

As it can be noticed by FIGS. 3 and 4, the piece 2B defines an inner space indicated with S, which forms the above cited tank for the rinsing aid; as according to the present state of art, the amount of rinsing aid that can be introduced in the tank S through the respective plug 5 of FIG. 1 is sufficient for several washing cycles; it should also be noticed that the tank S has appropriate venting means, to put its inside part in communication with the outer environment; these means are of known type and consequently they are not detailed in the figures.

Reference 2B' indicates a flange, being integral with the piece 2B, for fastening the thermo-actuator 11; in the example, the flange 2B' has suitable seats able to receive fastening side wings or projections, being integral with the outer housing of the thermo-actuator 11.

References 12A, 12B and 12C indicate the above three lengths of the sliding seat 12 of FIG. 2 (lengths 12C not shown in FIG. 4), wherein a shaft 13 partially shown in FIG. 4 is inserted, as further detailed.

Reference 14 indicates a dosing chamber for the rinsing aid; reference 15 is a vent duct putting the inner part of the chamber 14 in communication with the outer environment; reference 16 indicates an outlet chamber which, following the welding of pieces 2A and 2B of the body 2, results in communication with the opening 6 of FIG. 1.

As it can be noticed from FIGS. 3 and 4, the outlet chamber 16 communicates directly with the length 12A, while the length 12B has an intermediate interruption 17, which bring the length 12B itself into communication with the dosing chamber 14.

From the above figures it can be further imagined how the length 12C is provided to let the length 12B and consequently the inner part of the chamber 14 to communicate with the space or tank S; it should also be noticed that the section of the vent duct 15 is smaller than the thickness of the length 2B, whereby both portions of the tank S extending to the right and left of the duct 15 are intercommunicating.

Figure 5:
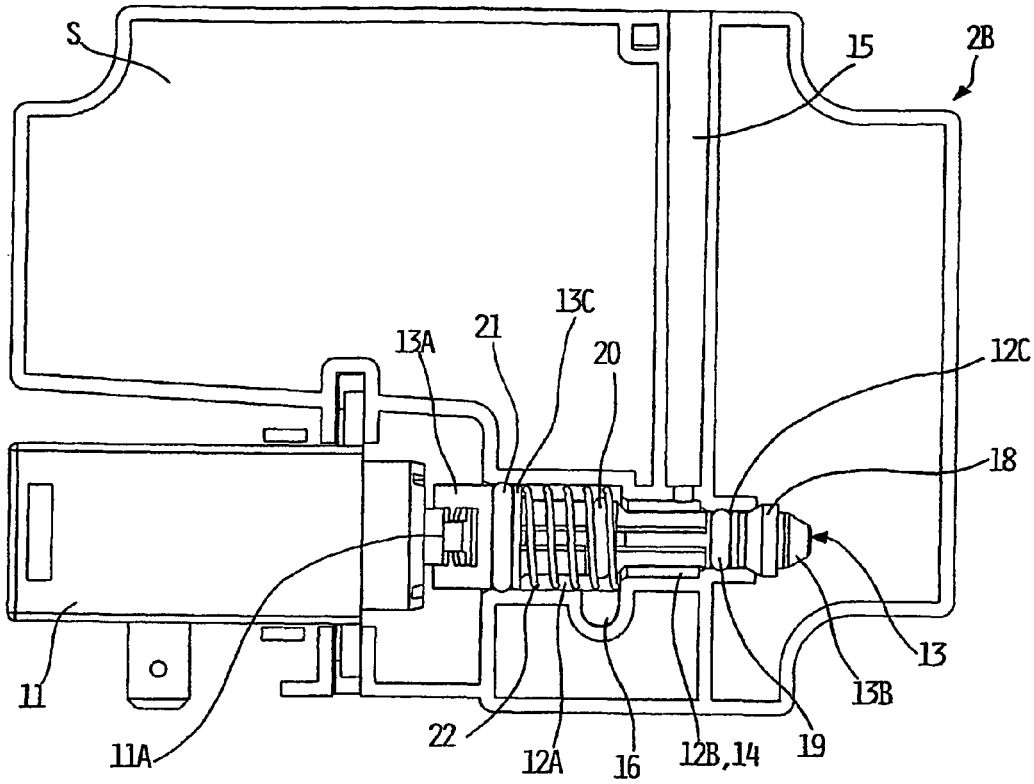
FIGS. 5 and 6 show a section, as a front view and perspective view, respectively, of the dispenser represented in FIG. 4, in a first operating condition.
Figure 6:
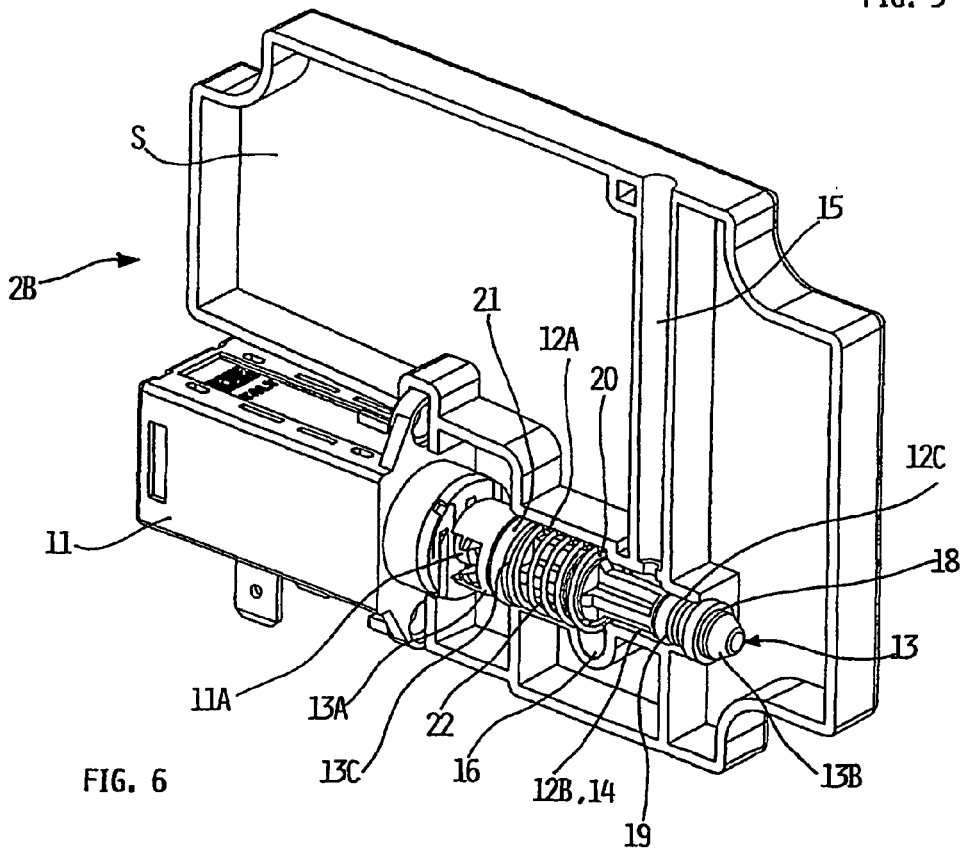

In FIGS. 5 and 6 the above rinsing aid dispenser is illustrated in different views, and in the operating condition already represented in FIG. 4.

These figures clearly illustrate the shaft 13, which has a substantially decreasing section from one end to the other (i.e. from left to right, with reference to the figure) according to the decreasing dimensions of the lengths 12A, 12B and 12C of the seat 12 illustrated in FIG. 2; as it will be noticed, the bigger end 13A of the shaft 13 is fixed to the piston 11A of the thermo-actuator 11; in the example, the fastening means consist of a direct coupling, or joint, of the Turkish head type.

Vice-versa, the head 13B of the shaft 13, i.e. the smaller end, is fitted with a front sealing element 18, consisting of a gasket made from elastic material with a substantially conical truncated section, inserted over the shaft head 13B.

Additionally, FIGS. 5 and 6 clearly illustrate how the portions of the shaft 13 inserted in the lengths 12A and 12B have a section being cross-shaped or anyway being of size and shape such to delimit side and/or internal passages.

Reference 19 indicates a first sealing element consisting of an o-ring inserted in a relevant seat defined in the shaft 13, near the head 13B; the ring 19 is sized for realizing a suitable radial sealing on the inner surface of the length 12C.

Reference 20 indicates a second radial sealing element, consisting of an o-ring in a relevant seat defined in the shaft 13 in an intermediate position between the seat of the sealing ring 19 and the end 13A; the ring 20 is sized to realize a suitable radial sealing on the inner surface of the length 12B (therefore, the outer diameter of the ring 20 is larger than the outside diameter of the ring 19).

Reference 21 indicates a third radial sealing element consisting of an o-ring inserted in a relevant seat defined in the shaft 13 near the end 13A; the ring 21 is sized for realizing a suitable radial sealing on the inner surface of the length 12A (therefore, the outer diameter of the ring 21 is larger than the outside diameter of the ring 20).

As it can be seen, in the operating conditions of FIGS. 5 and 6, where the thermo-actuator 11 is not powered:

the sealing elements 18 and 19 operate on the length 12C, the first one realizing a front sealing and the second one realizing a radial sealing to prevent the rinsing aid from flowing from the tank S to the dosing chamber 14;

the radial sealing element 20 results in being located in an intermediate site of the length 12A, substantially in correspondence with the outlet chamber 16; therefore, in this condition, the latter is in hydraulic communication with the dosing chamber 14 due to the cross-shaped section of the shaft 13 and the fact that the element 20 does not perform any sealing action during this step;

the radial sealing element 21 operates a radial sealing on the length 12A.

Finally, reference 22 indicates a spiral spring, inserted on the shaft 13 so as to be housed in the length 12A, which is pressure operated between a ledge 13C of the shaft 13 and the step formed between the length 12A and the length 12B.

Operation of the rinsing aid dispenser of the dispensing device according to the present invention is as follows.

Lets assume to be in the condition illustrated in FIGS. 5 and 6, and that in the tank S a certain amount of liquid washing agent is present, which has been previously supplied through the opening of the plug 5 of FIG. 1; lets also assume that the user of the dishwashing machine is starting a washing cycle.

At an appropriate time of the cycle, the machine control system supplies power to the thermo-actuator 7, for making, as previously described, the small cover 3 to open and supply the detergent powder to the tub.

At a subsequent time of the cycle (e.g. during one of the rinsing steps), the machine control system powers the thermo-actuator 11.

The piston 11A of the thermo-actuator 11 therefore moves and pushes the shaft 13 (to the right, referred to FIGS. 5 and 6), causing a consequent movement of the latter, to so that:

the sealing element 18 does no longer operate a front sealing on the end of the length 12C;

the sealing element 19 comes out frontally from the length 12C, i.e. it does no longer operate a radial sealing on it;

the sealing element 20 goes over from length 12A to length 12B, operating a radial sealing on the inner surface of the latter, upstream the interruption 17 of FIG. 2 or 3;

the spring 22 is pressed inside the length 12A.

It should be noticed that to this purpose the seats for the sealing element 19 and 20 are so arranged that as soon as the former come out of the length 12C, the latter is already inserted in the length 12B, preventing the inner part of the tank S from coming in direct communication with the outlet chamber 16.

The situation obtained after power supply to the actuator 11 and the ensuing movement of the shaft 13 is illustrated in FIGS. 7 and 8.

In this operating condition, the rinsing aid contained in the tank S is free to enter and fill the dosing chamber 14 through the length 12C and the interruption 17 of the length 12B; as mentioned above, this is possible because the shaft 13 has a cross-shaped section or anyway not such to obstruct the passage 12B–12C, and also due to the presence of the vent duct 15 putting the same chamber 14 in communication with the atmosphere.

It should be noticed that some of the rinsing aid entering the chamber 14 flows up along the duct 15 and reach a level inside it equalling the level of the rinsing aid in the tank S; the rinsing aid entering the dosing chamber 14, vice-versa, cannot reach the length 12A and the outlet chamber 16, due to the radial sealing action now exerted by the ring 20 on the inner surface of the length 12B.

Dosage of the rinsing aid required takes place in this condition. From what has been above described with reference to the function of the vent duct 15, it can be realized how the dispenser described above is capable of dosing variable amounts of rinsing aid, depending substantially on its level inside the tank S; as said, in fact, the amount of liquid washing agent flowing up in the duct 15 also depends on the level inside the tank S. However, it should be noticed that the vent duct 15 has a very narrow through-section (diameter in the order of ⅔ mm), and anyway calibrated to keep the amount of rinsing aid within the usual admitted tolerance thresholds (usually about 0.5 cc).

After a sufficient lapse of time for the above dosage (a few tens of seconds), power supply to the thermo-actuator 11 is stopped; thus, the piston 11A is brought backward to its initial position of FIGS. 5 and 6 by virtue of the action of the spring 22, and/or eventually of another elastic recall element arranged within the thermo-actuator 11 itself; it should be noticed, according to a possible variant embodiment, that said elastic element inside the thermo-actuator 11 could be in itself capable of causing a backward movement of the piston 11A, i.e. performing the functions of the spring 22, which could then be omitted.

Due to the above mutual positioning between the sealing elements 19 and 20, the element 19 re-enters length 12C during the backward movement of the shaft 13, operating a radial sealing to hinder a further rinsing aid flow from the tank S to the chamber 14; immediately afterwards, also the element 18 operates again a front sealing on the end of the length 12C, while the element 20 goes back to the length 12A to end its radial sealing action on the length 12B.

As a result, due to the particular cross-shaped or reduced section of the shaft 13, the dosing chamber 14 is in direct communication with the outlet chamber 16 and the length 12A; the rinsing aid contained in the dosing chamber 14 and the vent duct 15 flows up to the opening 6 of FIG. 1, to be discharged in the washing tub of the machine.

Thus, we are back again to the initial conditions of FIGS. 5 and 6.

The radial sealing element 21, operating all time and anyway on the inner surface of the length 12A, hinders the rinsing aid from flowing outside in the direction of the thermo-actuator 11; it should be noticed, on the other hand, how this creates an additional safety to the system, in view of the fact that the rinsing aid will never come in contact with the seal ring 21, since it is led to flow out much earlier through the outlet chamber 16.

Therefore, it should be pointed out that the dispensing and dosing system of the fluid washing agent previously described is intrinsically safe, also with reference to likely failures of the sealing elements 18 and/or 19 and/or 20; in fact, also in case of a simultaneous failure of the elements 18 and 19 the rinsing aid can only flow from the tank S to the outlet chamber 16 and from there into the washing tub of the machine.

It should also be mentioned that frictions hindering the sliding of the shaft 13 are quite high, due to the presence of the various sealing elements 19, 20 and 21; as a result, the energy to be developed by the spring 22 (and/or elastic element within the thermo-actuator 11) must be quite important to ensure a return of the shaft 13 to its initial position; as it appears from the above, the displacement of the shaft 13 to the working position of FIGS. 7 and 8 requires a considerable force to overcome the frictions and the force of the spring 22, an actuator of the type being indicated with 11 being capable of develop such a force.

Finally, it should be noticed how the entry of the sealing elements 19 and 20 in the lengths 12B and 12C is favored by appropriate bevels or flares, while being also lubricated by the rinsing aid itself.

From the above it is obvious how the control system of the dispenser described above is extremely simple, since it merely requires to supply an electric actuator for a limited time, in particular a thermal or thermoelectric actuator.

Also the manufacturing of the above dispenser is extremely simple and cost effective.

The piece 2B defining the tank S, the sliding seat 12 (i.e. lengths 12A, 12B and 12C), the chambers 14 and 16 and the vent duct 15 can be manufactured by molding a thermoplastic material with elementary operations; the same applies to the shaft 13. On the other hand, the various sealing elements 18–21, the spring 22 and the thermo-actuator 11 are standard components, usually manufactured in large quantity with a high reliability and low costs.

Also the assembly operations of the dispenser of the liquid washing agent previously described are quite simple: after inserting the spring 22 in the length 12A or on the shaft 13, the latter already fitted with the sealing elements 19, 20 and 21 is pushed inside its sliding seat until the head portion 13B of the length 12C protrudes out to such an extent to allow assembly of the front sealing element 18, e.g. by release or elastic expansion.

Now, the piece 2B can be welded to the piece 2A, e.g. through a hot blade method, and the thermo-actuator 11 assembled on the flange 2B', so that its piston 11A can be coupled to the end 13A of the shaft 13.

As to the easiness and reliability of assembly and operation it should be pointed out how one of the peculiar features of the present invention consists in the manufacture of both the sliding seat 12 of the shaft 13 and the essential radial sealing elements (i.e. rings 19 and 20), both of them featured by sections of decreasing size in their assembly direction.

Such decreasing sections allow a fully safe insertion of the sealing elements or rings, and namely ring 20, on lengths of the seat 12 were openings are provided (such as, for example, the outlet chamber 16 with respect to length 12A), without any risks of damages during assembly of the rings.

As mentioned, flares are also provided (shown in particular in FIGS. 5 and 7) between the lengths 12A–12B and 12B–12C, as well as in correspondence with the outlet of length 12C, in order to favor the insertion and the sliding of the radial sealing elements 19 and 20.

Should these flares be missing, the ring 19 might eventually be damaged due to the continuous displacements; in fact, due to the movement of the shaft 13 in its relevant seat, the ring 19 may meet the step defined between the length 12B and the length 12C during its sliding, with the risk of tearing.

The present invention has been described with specific reference to the dosage and dispensing of the rinsing aid in a dishwashing machine; however, it is clear that the invention can be applied in association to any kind of liquid washing agents, as well as to other washing machines, such as laundry washing machines.

The features of the present invention are clear from the above description and the annexed claims, which form an integral part of it.

From the above description and the annexed drawings also the advantages of the present invention are clear, in particular:

the dosage and the dispensing of the liquid washing agent are realized without having to change the resting or fastening plane of the dispenser itself, and without the need of vibration or peristaltic pumps and/or special water supply circuits;

the dispenser can be assembled on tilting doors, sliding doors or constantly vertical surfaces;

the number of moving parts for realizing the dosage and the dispensing of the liquid washing agent is minimized (practically only the shaft 13 and of course the relevant actuator 11 are movable parts);

the system is intrinsically safe against leakage of the liquid washing agent outside the device, since likely leaks would reach the tank or the washing tub; moreover, the system is made safe through the use of a plurality of sealing elements, in particular radial ones;

the movements required are elementary, since the dosing and the dispensing of the liquid washing agent are obtained through simple linear and opposite displacements of one same movable element, in particular in horizontal direction;

the actuation means for operating the device are simple and ensure a reliable power, operation and control with time; the same applies to the sealing means employed;

the components of the dosing and dispensing system of the liquid washing agent allow for a simple and low-cost manufacture and assembly.

It is obvious that many changes are possible for the man skilled in the art to the washing agents dispenser for a household washing machine, in particular a dishwasher, described above by way of example, without departing from the present invention.

In the embodiment previously described, the duct 15 extends between the dosing chamber 14 and the upper portion of the piece 2B, so that the relevant vent opening is located in the built-in section of body 2.

Therefore, it is clear that when the dispenser according to the present invention is assembled on a linear sliding door or a constantly vertical surface delimiting a washing tub, there is no leakage risk of the rinsing aid from such a vent opening.

It should be pointed out, on the other hand, that whenever the dispenser according to the present invention is assembled on a tilting door, there are no particular risks of leakage for the rinsing aid from the vent opening of the duct 15, since in normal conditions the machine door is open, i.e. potentially in a horizontal position, when both the chamber 14 and passage 16 do not contain any rinsing aid.

However, a remote possibility may arise for a user to open the machine door with the dispenser in the operating condition illustrated in FIGS. 5 and 6; such a theoretic situation may actually involve the risk of a certain amount of rinsing aid flowing outside through the vent opening.

Figure 9:
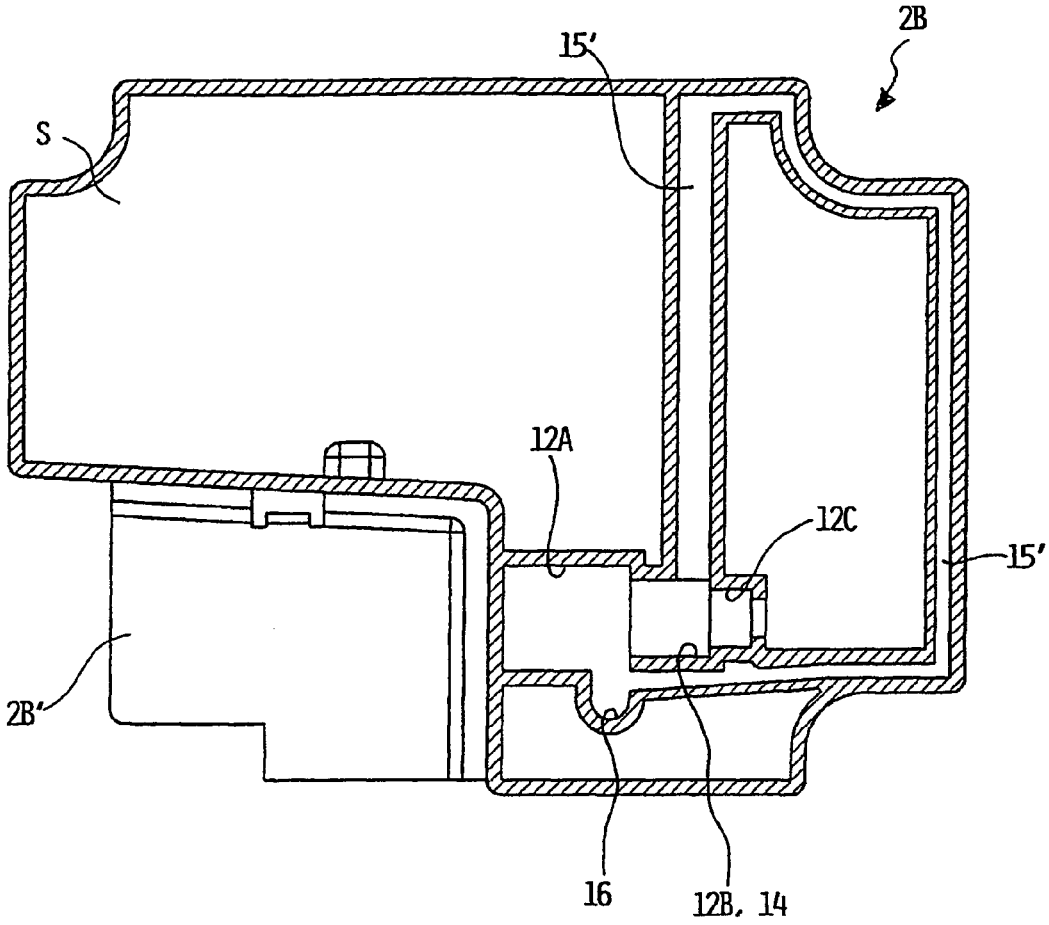
FIG. 9 shows a section of a component of a dispenser of liquid washing agents, according to a first possible embodiment of the present invention.

To this purpose FIG. 9 shows a possible embodiment according to the present invention, where a vent duct 15' is provided to let the inner part of the chamber 14 communicate with the outlet chamber 16 substantially through a "siphon" duct; considering that the outlet chamber 16 is always in direct communication with the outlet opening of FIG. 1, it can be realized how in such an unusual condition (door opening during dispenser operation), the rinsing aid eventually flowing up the duct 15 cannot be discharged on the door surface whereon the dispensing device 1 is assembled.

As to the remaining parts, the device shown in the embodiment of FIG. 9 operates exactly as described with reference to FIGS. 5–8.

The present invention has been described with reference to the use of a thermo-actuator, but it is clear that it can also be implemented with other actuating means, being not necessarily of the mono-stable type, such as pneumatic, electromagnetic or motor-driven means, which are able to provide the shaft 13 with the motion and force required.

The dispenser of liquid washing agents has been previously described with reference to the combined use of a dispenser of detergent powder or tablets with a tilting cover; however, it is clear that the dispensing device according to the present invention can only comprise the above dispenser of liquid washing agents or be combined with a detergent dispenser fitted with a sliding cover.

According to another possible embodiment, the dispenser 1 according to the present invention may be designed for having the plug 5 to be accessible from outside the washing tub or more in general from outside the machine; this could be provided e.g. through an opening on the front surface of the machine door and a duct departing in correspondence with it to reach the tank S across the thickness of the door; obviously, the end of the duct protruding from this front opening would be fitted with a plug like the previous one indicated with 5.

According to another possible variant embodiment, the dispenser 1 can have suitable selecting means, of the known type, for changing the useful volume of the dosing chamber 14.

It is also clear that the control system of the machine on which the device according to the present invention is assembled can be programmed for performing several supply cycles to the thermo-actuator 11, in order to obtain repeated dispensing of the liquid washing agent during one same wash cycle.

According to another possible variant embodiment, the chamber previously indicated with 14 can be omitted, whereas its dosing functions of the liquid washing agent may be performed by the same inner space of the seat 12; therefore, in this embodiment, also the interruption 17 of the length 12B can be omitted and have the latter connected directly to the vent duct 15 or 15'.

It is clear, in fact, that even in the absence of the dosing chamber 14, the smaller or cross-shaped section of the shaft 13 creates free spaces inside the length 12C and partially inside the length 12B (in particular the part extending between the sealing element 20 and the mouthpiece of the length 12C).

These free spaces, along with the vent duct, are able to receive a certain amount of the liquid washing agent, when the shaft 13 is in the operating condition of FIG. 5 or 6, which amount can be discharged in the tub when the shaft 13 goes over to the operating condition of FIGS. 7 and 8.

In the embodiment previously described, the dispensing device according to the present invention is equipped with two distinctive actuating means 7 and 11, i.e. one for actuating the detergents dispenser, the other for actuating the dispenser of liquid washing agents; however, it is obvious for the man skilled in the art that the dispenser described above may be fitted with a kinematic motion able to actuate both dispensers at different times, by means of one same actuating means, such as a thermo-actuator, e.g. according to the technique described in EP-A-0 602 572 or FR-A-2.593.379, or DE-A-33 04 037.

In FIG. 10, where the same reference numbers of the previous figures are used to indicate technical equivalent elements, illustrates a possible embodiment of a system for actuating both the above dispensers by means of one same thermo-actuator as previously indicated with 7 and 11.

In this figure, where the rear side of the dispenser according to the suggested embodiment is represented schematically and as a partial section in two different operating conditions, reference 30 indicates a linear toothed organ or rack element, engaged to a toothed wheel or pinion 31; the pinion 31 is associated to or defined by the end of a shaft extending through the body of the dispensing device, like the shaft 10 of FIG. 2; it is assumed, with reference to the suggested embodiment, that such a shaft is connected to the hooking lever 4 of the cover 3 of FIG. 1.

The two ends of the rack 30 are coupled, in a known way, to the shaft 13 and the piston 11A' of a thermo-actuator 11', respectively, being similar to those previously described; thus, the linear movement of the piston 11A' determines the linear movement of the rack element 30 and consequently of the shaft 13. As it can be realized from the arrangement shown in FIG. 10, the linear movement produced by the piston 11A' can be transformed through the rack element 30 and the pinion 31 into a rotary movement of the actuating shaft of the above lever 4.

Operation of the device according to the embodiment of FIG. 10 is very simple.

Upon starting a washing cycle, the device is in the condition illustrated in the part A of FIG. 10; in this situation, the lever 4 keeps the cover 3 of FIG. 1 of the space containing the detergent to be dispensed in its closed position.

At an appropriate time of the washing cycle, the control system of the machine supplies power to the thermo-actuator 11'; thereafter, the piston 11A' moves linearly, causing a corresponding linear displacement of the rack element 30; then the pinion 31 is moved angularly, causing a consequent angular movement of the shaft and relevant lever 4; thus, the cover 3 is free to open, so that the detergent contained in the relevant space can be discharged in the washing tub of the machine. This operating condition of the actuating system is represented in the part B of FIG. 10.

Obviously, the same movement causes also the shaft 13 to move in its seat 12 until an operating position similar to FIGS. 7 and 8 is reached; the rinsing aid contained in the tank S will then reach the dosing chamber 14 and partially the vent duct 15, as previously described.

Compared to the embodiment described with reference to FIGS. 1–9, in the example of the implementation shown in FIG. 10, the powered condition of the thermo-actuator 11' will last during the execution of the washing cycle, until the dispensing of the rinsing aid is required.

At that time, the control system of the machine will stop the power supply to the thermo-actuator 11', and the piston 11A' return to its initial position as previously described, until the system is back to the operating position of the part A of FIG. 10; thus, also a reverse movement of the shaft 13 is obtained, with a consequent release of the rinsing aid into the washing tub, as per the procedure previously described with reference to the switching over from the operating position of FIGS. 7–8 to that of FIGS. 5–6.

According to the above procedure it is clear that also the rack element 30, the pinion 31, the shaft and the relevant lever 4 will return to their respective initial positions; it should be noticed that the lever 4 is fitted with a per se known elastic system, for the manual closure of the cover 3 without causing any significant movements of the relevant shaft and/or pinion 31 and/or rack 30.

The actuating system described with reference to the FIG. 10 is also particularly advantageous in order to realize a rotary dispenser of the powder or solid detergent, instead of a dispenser with a space and a relevant closing cover. An example of this variant embodiment is represented in FIGS. 11–17.

In these figures, reference 40 indicates as a whole a container which can be tilted, able to receive a certain amount of detergent as required for executing a washing cycle, which in this instance is assumed to be a powder detergent; reference 40A indicates gripping means being defined on the front surface of the container 40, which ensure its easy tilting forward, as further described; the container 40 can be easily molded in one piece from thermoplastic material.

Reference 41 indicates a seat, defined in the dispenser body 2, which is provided for housing the container 40; in general, the dimensions of the seat 41 are larger than the ones of the container 40, whereby a portion of the former not occupied by the latter is facing directly inside the washing tub of the machine.

In this example, the seat 41 has a shape in plan being substantially elongated downwards, over the overall dimensions of the container 40, so that lower portion of the seat form a discharge passage for the detergent, as further described.

Figure 12:
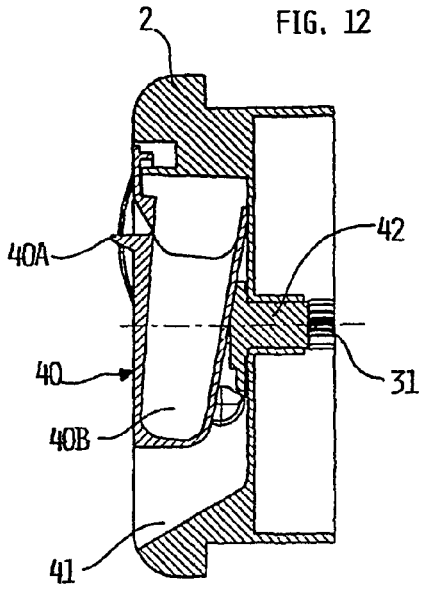
FIG. 12 shows a section of the dispenser of washing agents along the axis A—A of FIG. 11.

From FIG. 12 it can be noticed how the container 40 has an inner space 40B open upwards, able to contain the amount of detergent required for performing a washing cycle; this figure also illustrates how in this case the pinion 31 of FIG. 10 is integral with a fork element for supporting the container 40, indicated as a whole with 42, which is located inside the seat 41.

The fork element 42, being clearly shown in FIG. 17, consists of a main plate 42A, whose side ends delimit flanges 42B, each one fitted with a respective through hole 42C; these holes 42C receive pins 40C, also visible from FIG. 17, defined on projections 40D departing from the rear surface of the container 40; the fork element 42 can be advantageously molded in one piece from thermoplastic material or over-molded or co-molded with the pinion 31, should the latter be made from metal material.

Figure 13:
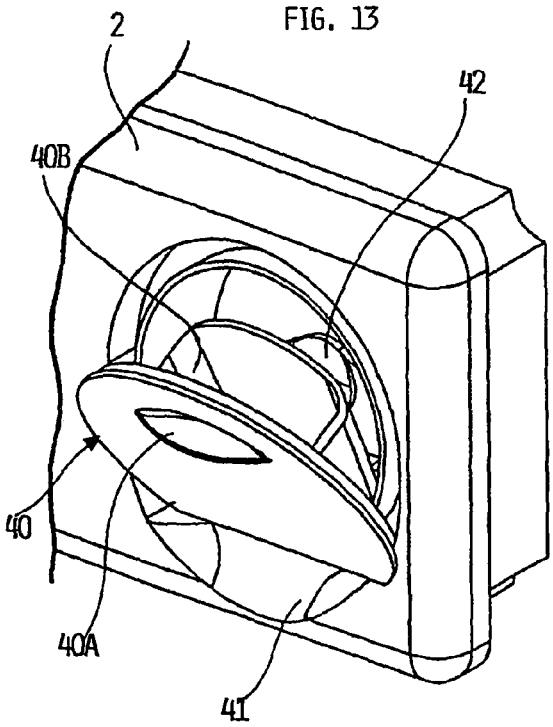
FIG. 13 shows a perspective partial view of the dispenser of washing agents represented in FIG. 11, in a second operating condition.
Figure 14:
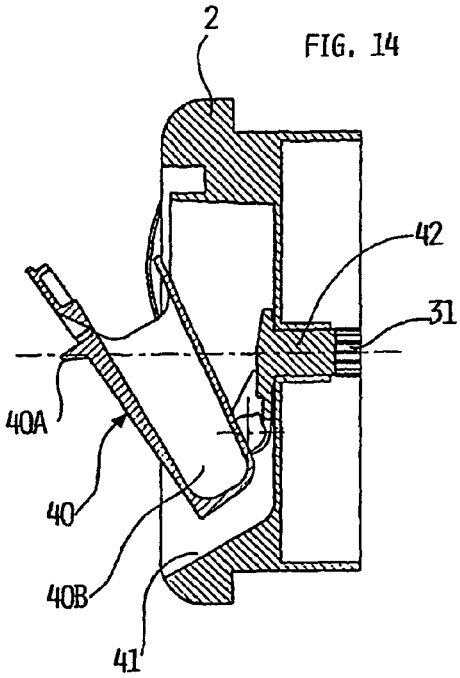
FIG. 14 shows a section, along an axis similar to the axis A—A of FIG. 11, of the dispenser of washing agents in the operating condition of FIG. 13.

Therefore, as it can be realized, the container 40 can be tilted with respect to the fork element 42, by virtue of the coupling between the holes 42C and pins 40C; thus, the container 40 can be partially tilted outside the seat 41, to allow the charging of the detergent in the space 40B; this situation is illustrated in FIGS. 13 and 14.

Moreover, as it can be realized, since the fork element 42 is integral with the pinion 31, a rotation of the latter produced by the thermo-actuator 11' of FIG. 10 causes the container 40 to rotate by about 180°; thus, the opening of the space 40B can be brought in correspondence with the lower area of the seat 41, which as said is facing directly inside the washing tub, in order to discharge the detergent dose; this situation is illustrated in FIGS. 15 and 16.

As it can be noticed from the annexed figures, the surface of the lower area of seat 41 is substantially inclined, to facilitate a downfall of the detergent into the washing tub of the machine and cleaning through the water splashes in the tub after the thermo-actuator 11' has upturned the container 40, as described above.

The device according to the suggested implementation is preferably fitted with means able to prevent an undesired tilting or opening of the container 40, which means may consist e.g. of an elastic element or engaging/release teeth operating between the fork element 42 and the container 40.

Operation of the device according to the suggested variant implementation is quite simple.

Figure 11:
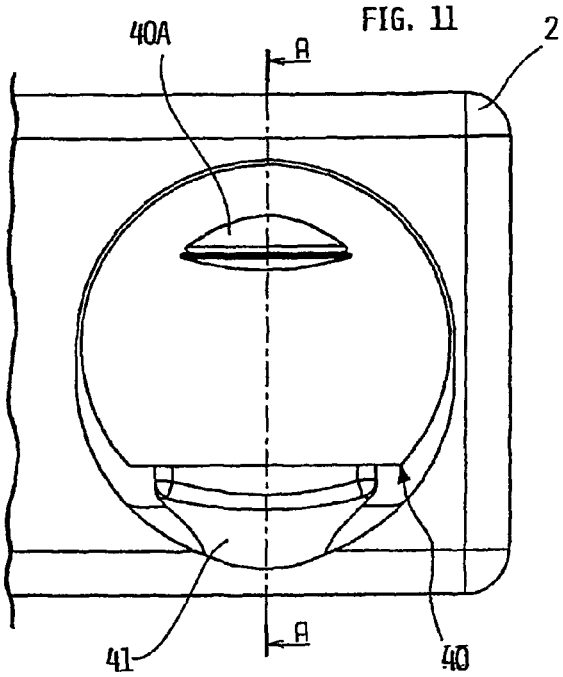
FIG. 11 shows a partial front view of a dispenser of washing agents according to a third possible embodiment of the present invention, in a first operating condition.

Let us assume to this purpose that the system is in the condition of FIGS. 10–12.

After loading the crockery to be washed in the washing tub, with the machine door half open, the user opens the container 40, i.e. tilting it out of its relevant seat 41, as previously described with reference to FIGS. 13–14.

In this operating condition, the user is able to fill the recess 40B of the container 40 with the amount of detergent required for performing the washing cycle. Then the user can push the container 40 inside the seat 41, close the machine door and start the washing cycle as commonly known.

At an appropriate time of the washing cycle, the control system of the machine supplies power to the thermo-actuator 11', as previously described with reference to FIG. 10.

The ensuing rotation of the pinion 31 produces an analogous rotation of the fork element 42, causing a displacement of the container 40 to the operating condition shown in FIGS. 15–16. It should be noticed, in this case, how the stroke of the piston 11A' and the ratios between the toothing of the rack element 30 and the pinion 31 of FIG. 10 will be advantageously provided for obtaining a movement of about 180° of the container 40, up to the position of FIGS. 15–16, following a power supply cycle of the thermo-actuator 11'.

The above up-turning of the container 40 will obviously cause a detergent discharge from the space 40B to the lower open area of the seat 41, and its consequent discharge inside the washing tub.

It should be noticed that during this stage, said discharge is favored by the likely water splashes hitting the lower open area of the seat 41, which fully remove the detergent from that area; it should also be noticed that in the operating condition of FIGS. 15– 16 the upper area of the seat 41 is facing directly inside the washing tub; as a result, also the water entering from that area and flowing downwards inside the seat 41 will help in removing the detergent during dispensing, as well as for the washing of the seat 41.

Obviously, actuation of the thermo-actuator 11' will also cause the movement of the shaft 13, with a consequent dosage of the rinsing aid amount required, as previously described.

The power supply condition of the thermo-actuator 11' is maintained until the dispensing of the rinsing aid is required.

When the dispensing has to take place, the control system of the machine stops the power supply; thus, the piston 11A', the rack element 30, the pinion 31, the fork element 42 and the shaft 13 return to their initial position and the rinsing aid can be dispensed inside the washing tub, while the container 40 receives an opposite rotary movement to go back to the operating condition of FIGS. 11–12.

The manufacturing of the detergent dispenser with a rotary container 40 is extremely simple and inexpensive.

The piece of body 2 where the seat 41 is defined can be easily molded from thermoplastic material; the same applies to the container 40 and the fork element 42, which may comprise the pinion 31 or be over-molded or co-molded with it. As it can be realized, also the assembly operations of the various components of the detergent dispenser are extremely simple.

As it can be seen, the suggested implementation of FIGS. 11–17 allows to manufacture a dispensing device intended to facilitate a user's actions to all effects, for the loading of both a liquid washing agent and any solid or powder washing agent, without requiring a fully open door of the washing machine.

For this reason, the dispenser according to the suggested variant implementation can be advantageously assembled on tilting doors, as well as fixed on constantly vertical surfaces, linear sliding doors and baskets designed like drawers.

The present invention has been described with reference to the use of actuating means able to generate a thrust on the shaft 13; however, it is clear that by means of simple changes well known to the man skilled in the art, the thermo-actuator 11 or 11' can be replaced by a thermo-actuator able to exert a pull, instead of a thrust on the shaft.

A further possible variant embodiment of the present invention is illustrated schematically in FIG. 18, where the same reference numbers of the previous figures are used to indicate technical equivalent elements.

In this figure, reference 12' indicates as a whole a sliding seat for a shaft 13', the latter having an end rigidly coupled to the piston 11A of a thermo-actuator 11.

The second end of the shaft 13' has a head 13B', on which the seat for a radial seal ring is defined, such as an o-ring 19'.

Reference 15" indicates a vent duct for putting the inner part of the seat 12' in communication with an outlet chamber 16, which communicates with an opening like the one indicated with 6 in FIG. 1.

Reference 21' indicates a further radial sealing element inserted in a suitable housing within the seat 12'.

Also operation of the embodiment illustrated in FIG. 18 is very simple.

During the power supply cycle of the thermo-actuator 11, the piston 11A of the latter pushes the shaft 13' until its head 13A', and then the radial sealing element 19', come out of the seat 12' inside the tank S. Thus, the seat 12' fills with rinsing aid, a portion of which also reaches the inside of the vent 15", for the reasons described above.

This operating condition is illustrated in the part B of FIG. 18.

Following a power cutoff of the thermo-actuator 11, the piston 11A can return to its initial position, carrying the shaft 13' with it, as previously described. Thus, the head 13B' and sealing element 19' re-enter the seat 12', pressing the rinsing aid in the seat itself; thus, the rinsing aid is pushed along the vent duct 15" up to the outlet chamber 16, wherefrom it can be dispensed in the washing tub of the machine.

This operating condition is illustrated in the part A of FIG. 18.

As it can be seen, the implementation shown schematically with reference to FIG. 18 provides for the use of elements being substantially similar to those previously described, but in this case the system allows for realizing a certain "pump" effect on the amount of rinsing aid to be dispensed.

It is obvious, according to the suggested implementation, that after dispensing the rinsing aid, a certain amount of it will remain within the vent duct 15"; however, this does not involve any leakage risks, since also in this circumstance the only outlet for any rinsing aid rests is represented by the chamber 16, which is actually open out to the surface on which the dispensing device is assembled.

Obviously, many other changes are possible for the man skilled in the art to the dispenser of washing agents for a household washing machine, in particular a dishwasher, described above, and it is also clear that in practical actuation of the invention the components may often differ in form and size from the ones described and be replaced with technical equivalent elements.

The invention claimed is:

1. A device for dispensing washing agents for a household washing machine, said device for dispensing comprising a housing with a tank, a discharge outlet, a dosing space, a first opening between said dosing space and said discharge outlet, a second opening between said tank and said dosing space, and a passage between said first opening and said second opening, sealing means comprising an element axially reciprocally movable within said passage and having a stroke extending between a first position and a second position, said movable element when in said first position, and during movement along a first terminal segment of its stroke adjacent thereto, sealing said first opening for preventing liquid flow from said dosing space to said discharge outlet and exposing said second opening for allowing liquid flow from said tank to said dosing space, said movable element when in said second position and during movement along a second terminal segment of its stroke adjacent thereto sealing said second opening for preventing liquid flow from said tank to said dosing space and exposing said first opening for allowing liquid flow from said dosing space to said discharge outlet, said movable element when in an intermediate segment of its stroke, between said first and second segments, simultaneously sealing said first opening and said second opening for preventing liquid flow from said dosing space to said discharge outlet and from said tank to said dosing space, and an actuator for operating said sealing means, said movable element during its movement between said first position and said second position and back, never allowing fluid communication between said tank and said discharge outlet.

2. A device, according to claim 1, wherein said sealing means comprise at least a sealing element operating outside said dosing space.

3. A device, according to claim 1, wherein said movable element has two lengthwise ends and said sealing means comprise at least a sealing element associated with said movable element in an intermediate position between said two ends.

4. A device, according to claim 1, wherein said sealing means comprise at least a sealing element capable of operating on an inner surface of said passage for realizing a radial sealing.

5. A device, according to claim 4, further comprising a radial sealing element, said radial sealing element exiting from said passage into said tank when said movable element is brought to said first position, and re-entering said passage when said movable element is brought to said second position.

6. A device, according to claim 4, comprising a first radial sealing element and second radial sealing element capable of operating on an inner surface of said passage.

7. A device, according to claim 6, wherein said first radial sealing element operates along a first length of said passage and said second radial sealing element operates on a second length of said passage.

8. A device, according to claim 7, wherein said first length and said first sealing element have a smaller diameter than said second length and said second sealing element.

9. A device, according to claim 7, wherein said passage has at least a third length and said movable element comprises a further sealing element operating on said third length.

10. A device, according to claim 9, wherein said further element operates a radial sealing in said third length.

11. A device, according to claim 10, wherein said third length and said further sealing element have a larger diameter than said first length and said first sealing element, and/or than said second length and said second sealing element.

12. A device, according to claim 9, wherein said discharge outlet is in direct communication with said third length.

13. A device, according to claim 9, further comprising an elastic element for facilitating a displacement of said movable element from said first to said second position.

14. A device, according to claim 13, wherein said elastic element is located in said third length.

15. A device, according to claim 7, wherein said second length has an interruption, which is able to put said passage in communication with said dosing space.

16. A device, according to claim 1, wherein said sealing means comprise at least a front sealing capable of realizing a front sealing with respect to said passage.

17. A device, according to claim 16, wherein at least a portion of said front sealing element is constantly within said tank.

18. A device, according to claim 17, wherein when said movable element is in said second position, said front sealing element prevents inlet of liquid washing agent from said tank into said passage.

19. A device, according to claim 1, wherein said sealing means comprise a first seal and a second seal, which alternatively operate on said passage depending upon the position taken by said movable element.

20. A device, according to claim 19, wherein said first seal is realized by said first radial sealing element and said second seal is realized by said second radial sealing element.

21. A device, according to claim 1, wherein said passage has at least two lengths of different sections.

22. A device, according to claim 12, wherein said sealing means are provided for operating on different lengths of said passage.

23. A device, according to claim 1, wherein said dosing space is outside of said passage.

24. A device, according to claim 1, wherein said passage has an intermediate interruption.

25. A device, according to claim 1, further comprising a vent duct through which the inside of said dosing pace is connected with the outside of the device.

26. A device, according to claim 25, wherein said vent duct extends from said dosing space to said discharge outlet, said vent duct having a reduced section.

27. A device, according to claim 25, wherein said tank, said passage, said dosing space, said discharge outlet and said vent duct are molded at least partially in one piece only.

28. A device, according to claim 25, wherein during the passage from said first position to said second position, said movable element forces liquid washing agent contained in said vent duct up to said discharge outlet.

29. A device, according to claim 1, wherein said movable element comprises a portion having a cross sectional area smaller than a cross sectional area of said passage.

30. A device, according to claim 1, wherein said actuator is a linear actuator.

31. A device, according to claim 1, wherein said actuator is a mono-stable actuator.

32. A device, according to claim 1, wherein said actuator is of the thermal or thermoelectric type.

33. A device, according to claim 1, wherein said actuator has a moving element or shaft coupled to said movable element.

34. A device, according to claim 1, wherein said actuator has an outer housing with wings or projections suitable for insertion in seats defined in the body of the device.

35. A device, according to claim 1, wherein said actuator is able to impart a thrust to said movable element.

36. A device, according to claim 1, wherein said actuator is able to exert a pull on said movable element.

37. A device, according to claim 1, further comprising a second arrangement for dispensing at least a dose of a second washing agent.

38. A device, according to claim 37, wherein said actuator is provided also for actuating said second arrangement through a kinematic mechanism.

39. A device, according to claim 38, wherein said kinematic mechanism comprises a straight toothed organ or rack element, capable of moving under the thrust produced by said actuator, and a pinion engaged on said rack element.

40. A device, according to claim 37, wherein said second arrangement has a space for containing said second washing agent, and comprises a cover for closing for said space and means for maintaining said cover of said space in its closed position.

41. A device, according to claim 37, wherein said second arrangement comprises a dispensing body, having a space for containing a dose of said second washing agent, which rotates around a first axis.

42. A device, according to claim 41, wherein said dispensing body is capable of angular movement with respect to a second axis.

43. A device, according to claim 41, comprising a seat for housing said dispensing body, said dispensing body using capable of taking a first position, wherein said dispensing body is inserted in said seat, and a second position, wherein said dispensing body is inclined outside said seat for loading a dose of said second washing agent into said containing space.

44. A device, according to claim 43, wherein an area of said seat is facing directly inside the washing tub of the machine on which the device is assembled.

45. A device, according to claim 44, wherein said dispensing body is capable of being rotated around said first axis by said actuator, to bring the opening of said containing space substantially in line with said area, in order to ensure the discharge of the dose of said second washing agent.

46. A device, according to claim 43, further comprising means for preventing an undesired passage of said dispensing body from said first to said second position.

47. A device, according to claim 41, wherein said dispensing body is supported by a support element rotated by said actuator.

48. A device, according to claim 47, wherein said support element is fork shaped, said dispensing body being mounted in a movable and/or tiltable way with respect to said support element.

* * * * *